United States Patent [19]

Manuel

[11] 4,245,709

[45] Jan. 20, 1981

[54] REMOVABLE DRILL STRING STABILIZERS

[75] Inventor: Tom Manuel, Salt Lake City, Utah

[73] Assignee: Christensen, Inc., Salt Lake City, Utah

[21] Appl. No.: 33,988

[22] Filed: Apr. 27, 1979

[51] Int. Cl.[3] ..... E21B 17/10

[52] U.S. Cl. ..... 175/325; 403/370; 403/371; 297/23; 297/47; 308/4 A

[58] Field of Search ..... 175/323, 325; 308/4 A; 403/367, 370, 371, 223, 227, 229; 285/384, 385, 421; 279/46, 47

[56] References Cited

U.S. PATENT DOCUMENTS

| | | | |
|---|---|---|---|
| 129,691 | 7/1872 | Tasker | 285/322 X |
| 1,340,102 | 5/1920 | Ayres | 403/371 X |
| 1,814,480 | 7/1931 | Metcalf, Jr. et al. | 285/323 |
| 2,147,255 | 2/1939 | Hoppenstand | 403/371 X |
| 3,232,648 | 2/1966 | Franck | 285/322 |
| 3,276,824 | 10/1966 | Carter | 308/4 A |
| 3,642,079 | 2/1972 | Van Note | 308/4 A X |
| 4,002,214 | 1/1977 | Schaumann | 175/320 |
| 4,131,167 | 12/1978 | Richey | 175/323 |

*Primary Examiner*—James A. Leppink
*Assistant Examiner*—Richard E. Favreau
*Attorney, Agent, or Firm*—Subkow and Kriegel

[57] ABSTRACT

A stabilizer sleeve, or other sleeve, to be releasably mounted on a drill collar for centering a drill string in a well bore, includes an outer stabilizer sleeve to be mounted on the cylindrical periphery of the drill collar and having an internally threaded bore, the threads of which have conical roots, receiving an externally threaded yieldable sleeve member placed over the drill collar, the crests of the external threads also being conical, rotation of the yieldable member threading it into the stabilizer sleeve and effecting its contraction until its internal surface contacts the periphery of the drill collar, further rotation and tightening of the sleeve member in the stabilizer sleeve compressing the sleeve member against the drill collar periphery, with the crests bearing against the root portions of the internal sleeve threads to secure the sleeve frictionally in position on the drill collar.

10 Claims, 4 Drawing Figures

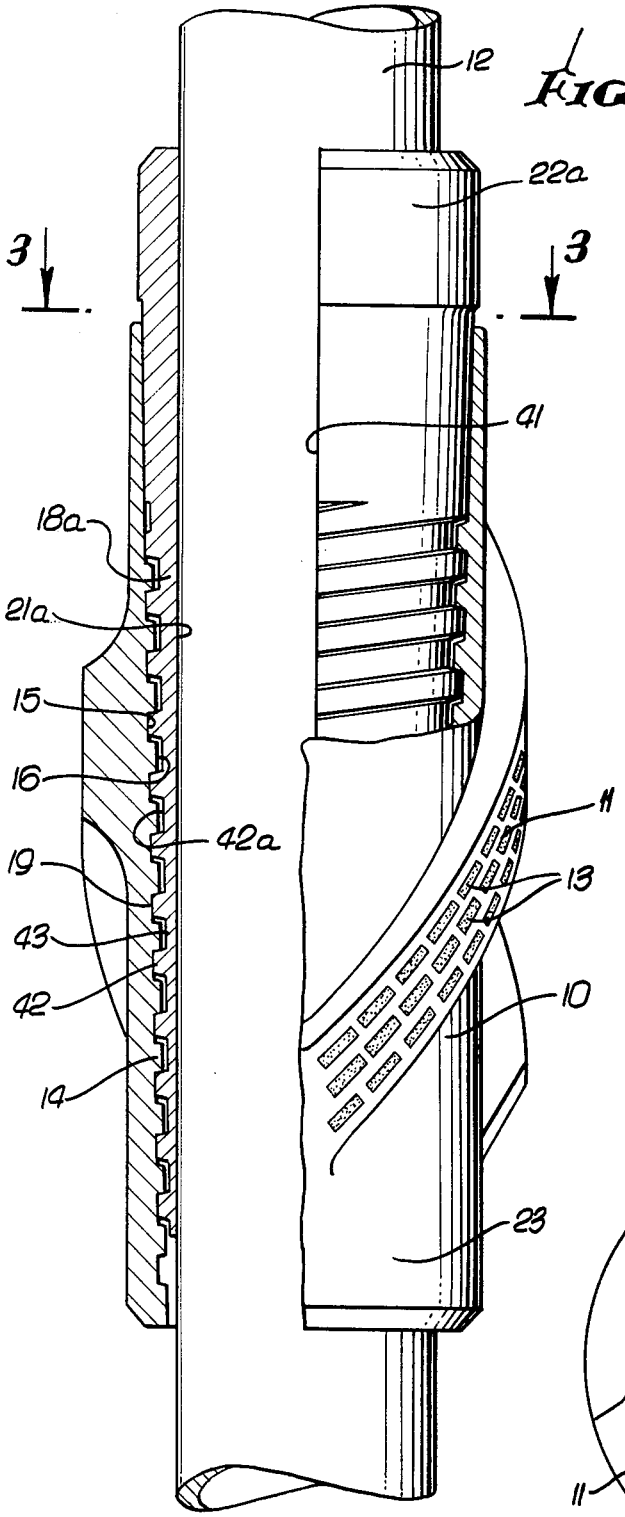
FIG. 2.
FIG. 3.
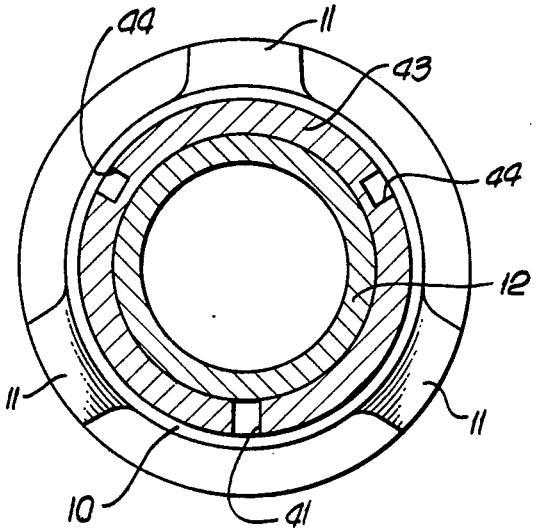

REMOVABLE DRILL STRING STABILIZERS

The present invention relates to rotary bore hole apparatus, and more particularly to stabilizers, and the like, mounted on a drill string section, such as a drill collar, to control deflection of the drill string, reduce or eliminate abrasive wear on the drill string sections, or to insure the drilling of the bore hole to its required diameter.

In U.S. Pat. No. 3,938,853, a drill string stabilizer is disclosed that can be mounted at any selected location along the length of a drill collar section. The stabilizer is firmly secured to the drill collar section by a shrink fit being effected between the stabilizer sleeve and an inner sleeve therewithin, this inner sleeve also being caused to make a shrink fit with the cylindrical periphery of the drill collar member itself. The shrink fit is effected through use of hydraulic equipment which must be available at the drill site, both in mounting the stabilizer apparatus on the drill collar and in removing it therefrom.

An object of the present invention is to provide a simple stabilizer arrangement adapted to be mounted on a drill collar, which does not necessitate the use of special hydraulic equipment for both mounting the stabilizer on the collar and in releasing it therefrom. Simple chain tongs, which are available on drill rigs, are used to provide the motive force for securing the stabilizer in a selected location along the cylindrical periphery of the drill collar, and in releasing it from the drill collar.

In general, a stabilizer sleeve is provided that has internal tapered threads which are cooperable with companion external threads of an auxiliary or inner flexible sleeve, so that rotation of the inner sleeve will cause it to thread into the outer sleeve and contract firmly into frictional engagement with the periphery of the drill collar. Such threading causes the crests of the external threads to firmly and frictionally engage the root portions of the internal threads of the stabilizer sleeve, firm tightening through rotation of the inner sleeve within the outer sleeve member increasing the compression of the inner sleeve member between the stabilizer sleeve and the drill collar, the several parts being frictionally secured to one another and preventing relative movement in any direction of the stabilizer sleeve with respect to the inner sleeve and drill collar.

This invention possesses many other advantages, and has other purposes which may be made more clearly apparent from a consideration of several forms in which it may be embodied. These forms are shown in the drawings accompanying and forming part of the present specification. They will now be described in detail, for the purpose of illustrating the general principles of the invention; but it is to be understood that such detailed description is not to be taken in a limiting sense.

REFERRING TO THE DRAWINGS

FIG. 2 is a view similar to FIG. 1 of another specific embodiment of the invention;

FIG. 3 is a cross-section taken along the line 3—3 on FIG. 2.

Figure 1:
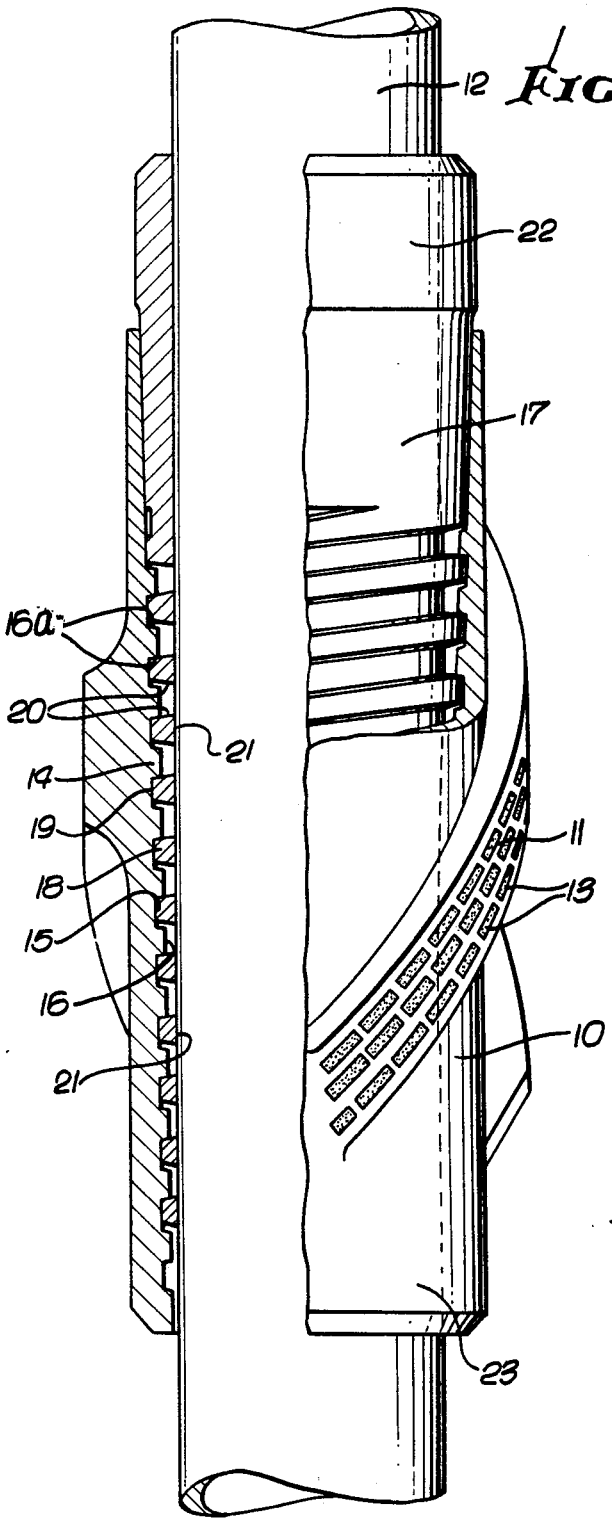
FIG. 1 is a combined side elevational view and longitudinal sectional view of an embodiment of the invention.

As disclosed in FIG. 1, a stabilizer sleeve 10 having circumferentially spaced outer ribs 11 thereon is to be firmly secured in a desired loction on a drill collar section 12 forming part of a drill string disposed in a well bore. As illustrated, the peripheries of the ribs may have hardfacing material 13 applied thereto, in a known manner, to resist wear of the ribs. The internal diameter of the stabilizer sleeve is slightly greater than the external diameter of the drill collar, to enable the sleeve to be slipped over the collar to a desired location along its length at which the sleeve is to be secured. The stabilizer sleeve has internal threads 14, disclosed as right hand threads, which are tapered, the roots 15 of the threads preferably being flat and of conical configuration, the crests 16 of the internal threads also being tapered. The side faces 16*a* of the threads are tapered, converging in a direction toward the stabilizer sleeve axis.

An inner sleeve 17 is adapted to be slipped over the end of the drill collar section and moved toward the upper end of the stabilizer sleeve 10. This inner sleeve has its main portion formed as a helical spring 18 which provides external tapered threads having flat crests 19 lying on a conical surface and conforming to the flat roots 15 of the internal stabilizer sleeve threads, so as to make surface contact therewith. The side faces 20 of the external threads are also tapered, while the internal surface 21 of the helical spring is cylindrical, having an initial diameter, prior to insertion of the inner sleeve within the stabilizer sleeve, slightly greater than the external diameter of the drill collar 12.

The inner sleeve 17 also includes an upper collar portion 22 integral with an adjacent uppermost turn of the helical spring, this collar being adapted to receive a suitable tool, such as a chain tong, when the inner sleeve 17 is to be rotated and threaded downwardly within the stabilizer sleeve 10. It is to be noted that the lower outer portion 23 of the stabilizer sleeve below the ribs 11 is cylindrical to receive another chain tong, or similar tool.

Right hand rotation of the inner sleeve 17 within the outer sleeve 10 screws the spring portion 18 into the internally threaded stabilizer sleeve. As such turning proceeds, the spring portion contracts until it contacts the periphery of the drill collar 12, the inner surface 21 of the spring being in full contact with the collar periphery and the crest portions 19 of the spring threads being in firm flat engagement with the root portions 15 of the stabilizer sleeve. Further rotation of the inner sleeve with respect to the stabilizer sleeve in the right hand direction will result in the exertion of a compressive force of the roots 15 of the stabilizer sleeve against the helical spring and of the inner cylindrical surface 21 of the helical spring against the periphery of the drill collar, effecting a very great frictional engagement of the inner sleeve against the root portions of the stabilizer sleeve, and of the cylindrical surface of the inner sleeve against the periphery of the drill collar.

Figure 4:
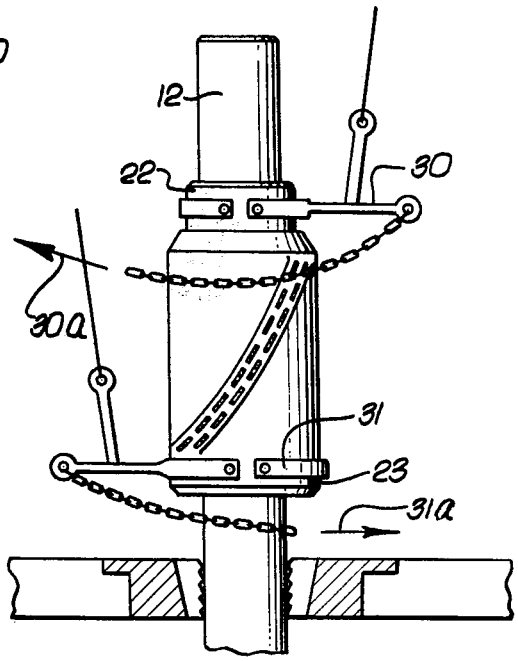
FIG. 4 discloses an apparatus that can be used in effecting assembly of the stabilizer apparatus on a drill collar member, as well as its disassembly from the drill collar.

The assembly of the apparatus can take place as shown diagramatically in FIG. 4, in which upper chain tongs 30 are brought into engagement with the periphery of an upper collar portion 22 of the inner member, lower chain tongs 31 being brought into appropriate engagement with the periphery of the lower portion 23 of the stabilizer sleeve. The pulling on the chain tongs 30 indicated by the arrow 30*a* to turn the inner sleeve 17 to the right, and the holding of the lower chain tongs 31 in a fixed position, as by exerting a force thereon indicated by the lower arrow 31*a*, will produce the inward threading of the inner sleeve 17 within the stabilizer sleeve 10, and the bringing of the parts of the assembly into firm frictional holding engagement with respect to one another, as shown in FIG. 4.

The holding force referred to above can be increased by appropriately treating the cylindrical inner surface 21 of the spring, as by rough machining, knurling, or coating it with a suitable hard grain, such as tungsten carbide particles, silicon carbide or corundum, to create a high friction coefficient between the spring and the periphery of the drill collar. The root portions 15 of the stabilizer sleeve and the companion crests 19 of the spring are not disturbed, inasmuch as the root and crest surfaces must move slightly in producing a great amount of compression stress between the parts.

When the stabilizer apparatus is to be removed, the lower chain tongs 31 can be applied to the lower cylindrical portion 23 of the stabilizer sleeve and the upper chain tongs 30 to the upper collar 22, the upper tongs being turned in a left hand direction, to unscrew the inner sleeve 17 from the outer sleeve 10, which permits the inner sleeve and stabilizer sleeve to be stripped off the upper end of the drill collar.

In the form of the invention disclosed in FIG. 2, the upper collar 22*a* is made integral with an inner sleeve 18*a* that has a split or slot 41 through its wall throughout its length, to permit the inner sleeve to expand and contract. External threads 42 extend from the inner body 43 of the inner sleeve, these threads being tapered and conforming to the taper of the internal threads 14 within the stabilizer sleeve 10. Expansion and contraction of the inner sleeve is facilitated by forming a plurality of circumferentially spaced longitudinal grooves 44 in the inner sleeve, as shown in FIG. 3.

In both embodiments, the roots 15 of the stabilizer sleeve threads are tapered in a downward direction at a relatively shallow angle which, for example, may range from about 0.286° to 1.43°, and that the crests 16 of the internal threads also taper in a downward direction to the same extent. Similarly, the crests 19 of the external threads are tapered to conform to the taper of the roots 15. The roots 42*a* of the external threads 42 on the inner sleeve are tapered to conform to the taper of the internal thread crests 16. By tapering the roots 42*a* of the inner sleeve threads, a thicker wall remains between the cylindrical internal surface 21*a* of the inner sleeve and the roots 42*a* of the threads of the inner sleeve, the thickness declining in a downward direction, as seen in FIG. 2. The net result is a stronger inner sleeve that can safely withstand inward crushing forces during the threading of the inner sleeve in the stabilizer sleeve.

The inner sleeve shown in FIG. 2 is mounted in the stabilizer sleeve 10 and on the drill collar 12 in the same manner as described in connection with FIG. 1. The rotation of the inner sleeve to the right will thread it downwardly within the stabilizer sleeve, with the tapered crests 19 of the inner sleeve sliding along the correspondingly tapered roots 15 of the outer sleeve to constrict the inner sleeve, as permitted by the longitudinal slot 41, and bring its internal cylindrical surface 21*a* into firm frictional engagement with the periphery of the drill collar. The application of sufficient torque to the inner sleeve will move it further downwardly with respect to the outer sleeve and increase the friction force between the cylindrical wall of the inner sleeve and the drill collar, and also between the thread crests of the inner sleeve and the thread roots of the outer sleeve engaged thereby.

The stabilizer apparatus of FIG. 2 can be released and removed from the drill collar in the same manner as described above in connection with FIG. 1, by turning the inner sleeve to the left and unthreading it in an upward direction relative to the stabilizer sleeve. Disconnection between both the inner and outer sleeves permits them to be moved upwardly along the drill collar and completely from its upper end.

As described above in connection with FIG. 1, the internal surface 21*a* of the inner sleeve of FIG. 2 can be rough machined, knurled or coated with hard grain material, such as tungsten carbide particles, silicon carbide or corundum, to increase the coefficient of friction between the inner sleeve and the drill collar, the inner sleeve being turned with respect to the stabilizer sleeve to move the inner sleeve further inwardly with respect to the stabilizer sleeve, and increase the compressive force of the cylindrical surface 21*a* of the inner sleeve against the periphery of the drill collar.

From a consideration of the two embodiments disclosed in the drawings and described above, it is evident that the design is relatively simple, the entire stabilizer apparatus comprising two parts only. No special equipment is required, other than tongs to grip the collar 22 of the inner sleeve and the cylindrical portion of the outer sleeve 23. The stabilizer apparatus can be frictionally secured to the drill collar and withstand very high forces, despite the fact that there are large tolerances between the diameter of the drill collar and the initial cylindrical inner diameter of the inner sleeve. The inner sleeve can be contracted sufficiently to overcome such difference in diameters. Moreover, the appropriate frictional engagement between the inner sleeve and drill collar, and between the inner sleeve and the stabilizer sleeve, is secured independently of the condition of the associated drill collar surface engaged by the inner sleeve.

I claim:

1. Apparatus adapted to be mounted on a cylindrical exterior of a drill string member disposed in a bore hole, comprising a contractible inner sleeve having an internal cylindrical surface adapted to frictionally engage a cylindrical surface of the drill string member and an external thread having external conical crests of longitudinally extending length, an outer sleeve surrounding said inner sleeve having internal threads provided with conical roots of longitudinally extending length frictionally engaging said conical crests and having a surface of contact therewith, and means for relatively turning said inner sleeve with respect to said outer sleeve to thread said inner sleeve longitudinally along said outer sleeve with said conical crests slidably engaging said conical roots to contract said inner sleeve and compress said inner sleeve between said conical roots and the drill string member, with said cylindrical surface of said inner sleeve frictionally engaging the cylindrical surface of the drill string member.

2. Apparatus as defined in claim 1; said inner sleeve having a portion extending beyond one end of said outer sleeve to receive a tool for applying torque to said inner sleeve.

3. Apparatus as defined in claim 1; said inner sleeve having at least one longitudinal split extending throughout its length.

4. Apparatus as defined in claim 3; said inner sleeve having one or more longitudinal grooves therein to increase the flexibility of said inner sleeve.

5. Apparatus adapted to be mounted on a cylindrical exterior of a drill string member disposed in a bore hole, comprising a contractible inner sleeve having an internal cylindrical surface adapted to frictionally engage a cylindrical surface of the drill string member and an external thread having external conical crests, an outer sleeve surrounding said inner sleeve having internal threads provided with conical roots frictionally engaging said conical crests, and means for relatively turning said inner sleeve with respect to said outer sleeve to thread said inner sleeve longitudinally along said outer sleeve with said conical crests slidably engaging said conical roots to contract said inner sleeve and compress said inner sleeve between said conical roots and the drill string member, with said cylindrical surface of said inner sleeve frictionally engaging the cylindrical surface of the drill string member, said inner sleeve comprising a helical spring having a plurality of turns, the inner portion of said turns providing said internal cylindrical surface and the outer portion of said turns providing said external conical crests.

6. Apparatus as defined in claims 1, 3, 4 or 2; said outer sleeve being a stabilizer engageable with the wall of a bore hole.

7. Apparatus as defined in claims 1, 3, 4 or 2; the angle of taper of said conical roots and crests ranging from about 0.286° to about 1.43°.

8. Apparatus as defined in claim 5; a collar secured to one end of said helical spring and extending beyond one end of said outer sleeve to receive a tool for applying torque to said inner sleeve.

9. Apparatus as defined in claims 5 or 8; said outer sleeve being a stabilizer engageable with the wall of a bore hole.

10. Apparatus as defined in claims 5 or 8; the angle of taper of said conical roots and crests ranging from about 0.286° to about 1.43°.

* * * * *